US005148990A

United States Patent [19]

Kah, Jr.

[11] Patent Number: 5,148,990

[45] Date of Patent: Sep. 22, 1992

[54] ADJUSTABLE ARC SPRAY AND ROTARY STREAM SPRINKLER

[76] Inventor: Carl L. C. Kah, Jr., 778 Lakeside Dr., N. Palm Beach, Fla. 33408

[21] Appl. No.: 546,120

[22] Filed: Jun. 29, 1990

[51] Int. Cl.[5] ..... B05B 1/32

[52] U.S. Cl. ..... 239/222.17; 239/457; 239/539; 239/DIG. 1

[58] Field of Search ..... 239/DIG. 1, 236, 461, 239/540, 579, 581.1, 240, 222.17, 457, 538, 539

[56] References Cited

U.S. PATENT DOCUMENTS 4,579,285 4/1986 Hunter ..... 239/DIG. 1
4,815,662 3/1989 Hunter ..... 239/DIG. 1
4,850,538 7/1989 Krahn ..... 239/DIG. 1
5,058,806 10/1991 Rupar ..... 239/DIG. 1

*Primary Examiner*—Andres Kashnikow
*Assistant Examiner*—Karen B. Merritt
*Attorney, Agent, or Firm*—Jack N. McCarthy

[57] ABSTRACT

An adjustable arc spary nozzle is set forth which includes a cylindrical member with an arc set member therein to provide adjustable flow directed into a spray deflector, either stationary or rotary. Modifications are presented to obtain varying effects to the flow. The spray deflector is shown: (1) fixed to the cylindrical member; (2) fixed to the arc set member; and (3) rotating.

41 Claims, 4 Drawing Sheets

ADJUSTABLE ARC SPRAY AND ROTARY STREAM SPRINKLER

DESCRIPTION

1. Technical Field

This invention relates to adjustable arc of coverage nozzles to provide uniform water precipitation over each area of coverage selected and to provide special patterns of precipitation.

2. Background Art

U.S. Pat. No. 4,867,378, issued Sep. 19, 1989, discloses a sprinkler having an adjustable arc of oscillation rotating nozzle with the arc of oscillation being setable and indicated on the top of the nozzle.

The market advantage for a sprinkler that can be easily set to cover a particular area from the top was discussed. The sprinkler of the referenced patent application was for large area coverage, long throw radius, oscillating nozzle sprinklers.

In U.S. patent application Ser. No. 516,362, filed Apr. 30, 1990, sprinklers of the oscillating nozzle type having automatically adjustable nozzles to provide proper water precipitation over each area of coverage selected was disclosed.

In U.S. Pat. No. 4,579,285, an adjustable arc of coverage spray nozzle sprinkler is disclosed where the arcuate orifice is at the nozzle outlet end with pressure trying to force the arcuate slot open such that it must be fixed or mechanically held in position.

The outlet orifice of prior art sprinklers is very vulnerable to being clogged by dirt since for the flow rate commonly used for commercial and residential sprinklers, the arcuate slots are very narrow. If disassembled for cleaning, proper reassembly for the correct slot height and precipitation rate is questionable. Small differences in slot height make significant precipitation rate differences. If upstream filters are provided, they have to have small openings but clog quickly, requiring disassembly of the sprinkler from its housing.

Rotary stream sprinklers are shown in U.S. Pat. No. 4,815,662; U.S. Pat. No. 4,842,201; and U.S. Pat. No. 4,867,379.

DISCLOSURE OF INVENTION

This application discloses a concept for providing an adjustable and indicated arc of coverage for smaller and intermediate areas of coverage sprinklers which can be fixed spray or have a rotating distributing head providing a plurality of streams for intermediate ranges with an adjustable arc of coverage and automatically provide for the same precipitation rate, i.e., one inch per square foot per hour, for the area covered by the selected arc.

The arc of coverage can easily be set and indicated on the top of the nozzle. Ease of setting a sprinkler for the required arc of coverage and having it provide a matched precipitation for its area of coverage to those sprinklers installed and set in other areas of the yard would greatly reduce the required inventory and time required for installation as well as provide more uniform coverage than now being achieved in present day installations.

Another feature of this invention not previously provided for in an adjustable arc of coverage sprinkler nozzle is the ease of cleaning. Being able to easily clean dirt from the arcuate slot used to control flow for the desired arc of sprinkler coverage is an important feature and greatly enhances the usability in systems with well pumped water and effluent water supplied systems.

In the configuration disclosed here, the adjustable arcuate opening is upstream with pressure trying to close it, thus making it a much simpler design to manufacture and also to clean by just pushing down on the center arcuate valving member against the pressure or small spring force to allow dirt particles to pass through. Also, a configuration is shown where the single piece arcuate valving control member may be easily removed and replaced from the top, which can also be used to easily provide some special patterns such as a strip spray (long rectangular pattern). Having the arcuate valving member removable from the top of the head with as few parts as possible also greatly enhances the ease of manufacture and service. The nozzle exit may be molded into the end of a riser tube for a pop-up sprinkler without regard to having to assemble or service small cavities or holes from the underside.

The disclosed configuration ensures getting the sprinkler reassembled with the proper flow area to provide for a matched sprinkler precipitation rate.

In the configuration disclosed here, flow slot height (thickness) is manufactured into the parts giving them a known precipitation rate for particular parts regardless of what arc is set.

Still another feature of having the arc setting arcuate valving action take place below the exit of the nozzle is the ability to apply the adjustable arc of coverage feature to a stream rotor sprinkler of the type described in my U.S. Pat. No. 4,353,507 and in U.S. Pat. Nos. 4,842,201; 4,815,662; and 4,867,379.

A setable arc of coverage configuration for a rotating distributing nozzle is shown. The benefits of this invention eliminate the need to inventory the many separate arc slots or flow selection discs that other sprinklers of this type require.

In the disclosed configuration, the precipitation rate of water per unit area of coverage is fixed by the slot thickness, i.e., inches of precipitation per square foot per hour. As the arc of coverage is changed, the slot thickness remains constant for the increased arc and the sprinkler's total flow rate is increased proportionally to the increased arc of coverage.

It is an important feature that the flow slot be set to give a known precipitation rate so that as the sprinklers are used in various parts of a lawn, that all areas receive water coverage equally, i.e., one inch per square foot per hour, regardless of the arc that is set or a random adjustment that someone may make.

The manufactured fixed slot thickness created between the center shaft and the nozzle housing hole fixes the precipitation rate regardless of what arc is set for the improved adjustable arc of coverage nozzles of this invention. Upstream throttling to control the sprinkler range and patterns is provided for but the discharge design slot thickness is maintained at the final discharge for all of the selected arcs and configurations.

A configuration is shown that provides for adjusting the range of coverage while retaining the distribution rate slot thickness. The range of coverage can be adjusted to compensate for system pressure differences at each head that has this added feature or throttle the pressure to the sprinkler's stream slot which will reduce the range of coverage and overall flow rate of the sprinkler. Other configurations are shown that selectively provide upstream discharge slot throttling around the selected arcuate slot for special sprinkler pattern effects.

It is the object of this invention to provide a simple, easily manufactured adjustable arc sprinkler that can be easily set for a desired arc of coverage and provides a predetermined uniform watering coverage pattern, regardless of what arc of coverage is set.

Another object is to provide a nozzle that can be easily cleaned.

Still another object is to provide a configuration where special pattern sprinklers can be provided by changing only a single part in a standard inventory housing.

A further object is to provide a simple two-part adjustable arc sprinkler where the arc selection member can be removed from the top (outside) for cleaning.

Another object of the invention is to provide an arc selection valving member setable from the outside of a rotating stream nozzle sprinkler for any desired arc of coverage.

Another object of the invention is to provide an adjustable arc of coverage fixed spray nozzle where the arc of coverage is setable and indicated on the top of the sprinkler.

Still a further object of the invention is to provide for various flow increases or decreases around the adjustable arcuate opening to produce particular patterns of different ranges as well as for the desired arc of coverage.

Another object is to provide an adjustable arc of coverage spray nozzle with an upstream of the nozzle pressure throttling means for spray pattern range control.

BEST MODE FOR CARRYING OUT INVENTION

Figure 3:
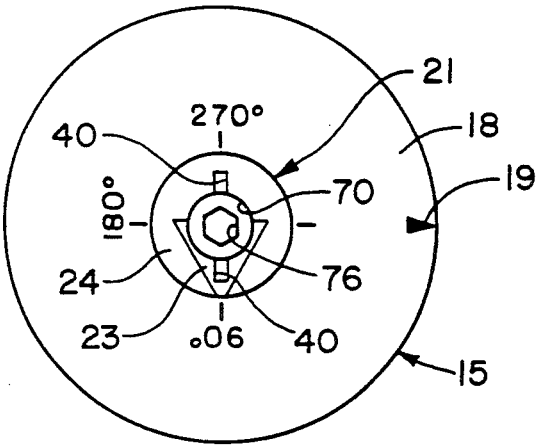
FIG. 3 is a top view of the spray nozzle of FIG. 1 showing the selected arc of coverage direct reading indication and with the addition of a center range correction adjustment screw having a hexagon-shaped socket as shown in FIG. 4.
Figure 2:
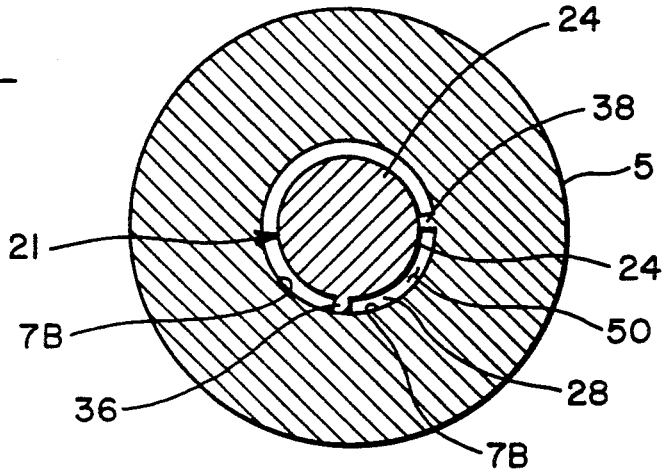
FIG. 2 is a sectional view taken on the line 2—2 of FIG. 1.
Figure 1:
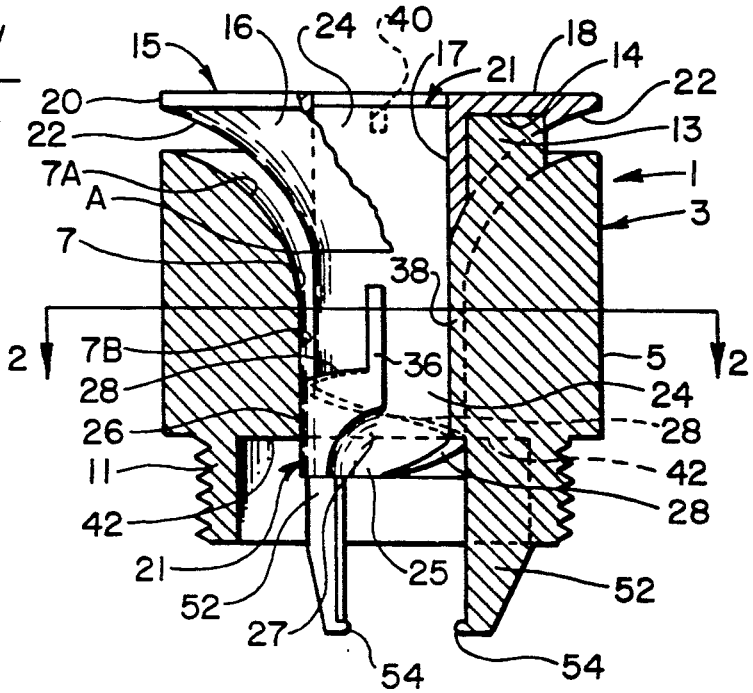
FIG. 1 is a side elevational view of an adjustable arc of coverage spray nozzle with the cylindrical housing in cross-section, the spray deflector member partially in section, and with the arc set selection member shown in full.

A basic spray nozzle assembly 1 with adjustable arc of coverage is shown in FIG. 1. It has only three (3) parts to provide a spray that provides a matched precipitation pattern for all the spray heads used in a system regardless of what arc of coverage they are set for. The three parts are:

(1) a cylindrical housing 3;

(2) a spray deflector member 15; and (3) an arc set selection member 21.

The cylindrical, or annular, housing 3 is defined by an outer circular wall 5 and an inner wall 7. Inner wall 7 has an upper upwardly diverging surface 7A and a lower cylindrical surface 7B. A threaded skirt 11, for attachment to a riser for supply of pressurized water, extends down from the bottom of the housing 3. The upper diverging surface 7A has a narrow rib 13 protruding upwardly for mounting and spacing a flow spray deflector member 15.

Spray deflector member 15 is formed having an annular body 16 with a center cylindrical opening, or hole, 17. Annular body 16 has an annular top surface 18 with a small peripheral edge 20. The annular top surface 18 has a diameter substantially equal to the outer circular wall 5. An upwardly diverging deflecting surface 22 has its upper end connected to peripheral edge 20 and is positioned in the upwardly diverging surface 7A of housing 3 and extends to a point radially inwardly of cylindrical surface 7B. The inner surface of the cylindrical hole 17 is formed to meet the deflecting surface 22 at a circular edge A.

A recess 14 is formed in the upwardly diverging deflecting surface 22 to receive the rib 13. The rib 13 provides (1) the supporting means for the spray deflector member 15; and (2) the spacing means for properly spacing the upwardly diverging surface 7A and the upwardly diverging deflecting surface 22. The rib 13 is fixed in the recess 14 by being glued or sonic-welded.

Arc set selection member 21 comprises a cylindrical member 24 with an enlarged lower end 26. Said enlarged lower end 26 appears as a sleeve-like member fixed to the cylindrical member 24 with a diameter larger than cylindrical member 24, and being coaxial therewith. Said sleeve-like member has an upwardly facing spiral surface 28 extending substantially 360° around the cylindrical member 24, and a downwardly facing lower surface at the bottom of cylindrical member 24 for a greater part of its circumference forming a radial extension thereof. The remaining part 25 of the circumference is open along with material removed at 27 to provide an enlarged inlet upwardly to a point just below the top edge of surface 28 and the front of the bottom edge of surface 28 where it enters the space between cylindrical member 24 and cylindrical surface 7B. Enlarged lower end 26 has a diameter sized to have a rotatable and slidable fit in the inner cylindrical surface 7B of housing 3, and cylindrical member 24 has a diameter sized to have a rotatable and slidable fit in the inner cylindrical surface of hole 17.

A narrow axial closure rib 36 is formed on the surface of cylindrical member 24 extending upwardly from the upper end of spiral surface 28 to permit axial movement of the arc set selection member 21 as it selects the proper arc. Axial rib 36 has a slidable fit within cylindrical surface 7B. A narrow axial closure rib 38 is formed on wall 7 of housing 3 extending along the inner lower cylindrical surface 7B from the bottom thereof, to meet with the rib 13, both being of the same width, on diverging surface 7A. The inner surface of axial rib 38 has a slidable engagement with cylindrical member 24.

The cylindrical member 24 has a groove 40 in the top thereof for receiving the end of a screwdriver, for example, for turning it to move axial closure rib 36 with respect to axial closure rib 38. It can be seen that an adjustable arcuate discharge slot 50 is formed between the movable axial closure rib 36, axial closure rib 38, cylindrical surface 7B, and cylindrical member 24. With spiral surface 28 biased against the lower end of axial rib 38, such as by water pressure, it can be seen that as the arc set selection member 21 is rotated clockwise to increase the adjustable arcuate discharge slot 50, the spiral surface 28 is cammed downwardly rotating the movable axial rib 36 away from the axial rib 38.

When the lower end of the arc set selection member 21 is below the bottom 42 of the cylindrical housing 3, the enlarged inlet provided by remaining part 25 and material removed at 27 is further enlarged by the admission of water flow over the spiral surface 28 to provide a greater supply as the adjustable arcuate discharge slot 50 enlarges. This movement of the lower end of arc set selection member 21 below the bottom 42 of the cylindrical housing 3 continues as long as the axial closure rib 36 has spacing to engage the bottom of axial closure rib 38. When the adjustable arcuate discharge slot 50 is fully open the arcuate discharge slot 50 is substantially a full circle, with the water flow from a riser or inlet pipe being directed directly into the fully open arcuate discharge slot 50.

Spray deflector member 15 has an arrowhead 19 on top surface 18 representing the location of axial closure rib 38, and arc set selection member 21 has an arrowhead 23 on its top surface representing the location of axial closure rib 36. Angular positioning of the spray nozzle is clearly indicated by indicia on the surface 18, such as 90°, 180° and 270°.

Three downwardly extending alignment and retention ribs 52 extend from the bottom 42 of cylindrical housing 3 around cylindrical surface 7B. It can be seen that the inner surface of these ribs 52 guide the enlarged lower end 26 of the arc set selection member 21 as it extends below its bottom. Further, inwardly projecting retention bumps, or projections, 54 prevent the arc set selection member 21 from dropping out of the cylindrical housing 3.

Figure 4:
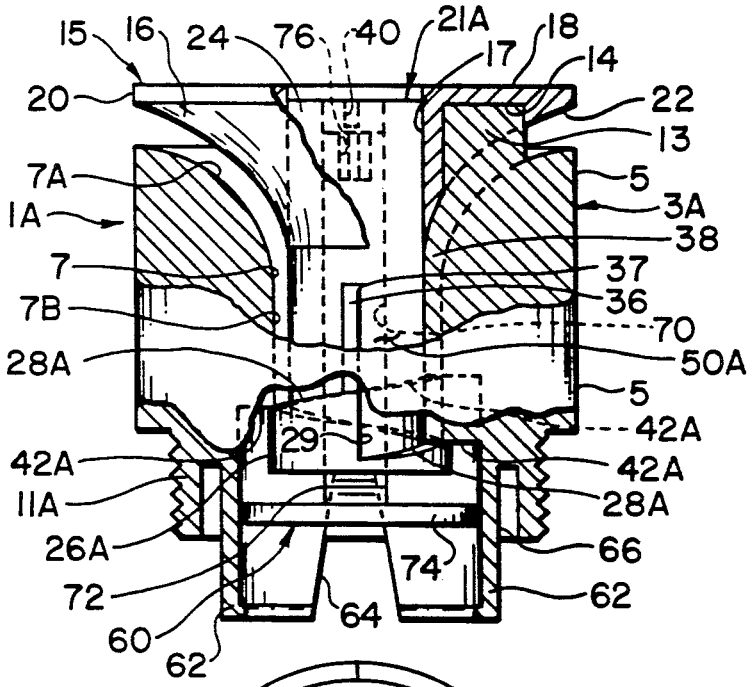
FIG. 4 is a cross-sectional side elevation view of a first modification of an adjustable arc of coverage spray nozzle with an upstream flow throttling adjustment screw added to control the coverage range, and with a clamping peripheral seal between matching axially offset spiral surfaces of the cylindrical housing and arc set selection member.
Figure 6:
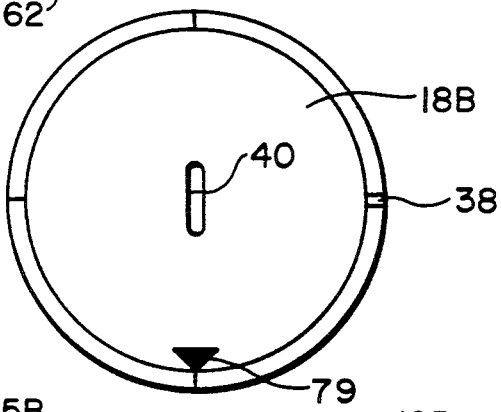
FIG. 6 is a top view of a two-piece adjustable arc of coverage spray nozzle as shown in FIG. 5.

A modified spray nozzle assembly 1A is shown in FIG. 4. It has four (4) parts; the parts are:

(1) a cylindrical housing 3A;

(2) a spray deflector member 15;

(3) an arc set selection member 21A; and (4) an upstream pressure throttling adjustment device 60.

The cylindrical, or annular, housing 3A is formed as housing 3 of FIG. 1 with the following exceptions:

(1) the bottom 42A of the cylindrical housing 3A is formed as a spiral surface from one side of axial rib 38 to the other;

(2) the threaded skirt 11A is formed having an additional inwardly spaced downwardly extending annular member 62 having two diametrically opposed inlet cut-out sections 64. The inlet cut-out sections 64 extend into the annular space 66 which receives flow from below the nozzle assembly 1A.

The spray deflector member 15 is formed as it is in FIG. 1.

The arc set selection member 21A is formed as arc set selection member 21 of FIG. 1 with the following exceptions:

(1) Arc set selection member 21A comprises a cylindrical member 24 with an enlarged lower end 26A. Said enlarged lower end 26A appears as a sleeve-like member fixed to the cylindrical member 24 with a diameter larger than cylindrical member 24, larger than inner cylindrical surface 7B, smaller than the inner diameter of annular member 62, and coaxial therewith. Said sleeve-like member has an upwardly facing spiral surface 28A extending substantially 360° around the cylindrical member 24, and a downwardly facing lower surface at the bottom of cylindrical member 24 forming an annular radial extension therearound. The enlarged lower end 26A has a diameter sized to have the outer part of spiral surface 28A engage the inner part of spiral surface 42A when biased upwardly by water pressure, for example, and cylindrical member 24 has a diameter sized to have a rotatable and slidable fit in the inner cylindrical surface of hole 17, as in FIG. 1.

(2) An axial cylindrical opening 70 extends through cylindrical member 24 to receive a threaded shaft 72 having a throttling disc 74 which has slidable engagement with the inner surface of annular member 62. The axial cylindrical opening 70 is internally threaded so as to permit threaded shaft 72 to be rotated such as by a hexagonal socket 76 and have axial movement to control placement of throttling disc 74 in relation to cut-out sections 64.

A narrow axial rib 36 is formed on the surface of cylindrical member 24 extending upwardly from the upper end of spiral surface 28A in line with the axial stepped surface 29 to permit axial movement of the arc set selection member 21A as it selects the proper arc. Axial rib 36 has a slidable fit within cylindrical surface 7B but does not extend to the outer surface of the enlarged lower end 26A. The slot closure rib 36 has a flow surface which is slightly deflected at the top at 37 to turn the slot flow along the rib 36 slightly inwardly towards the open arcuate slot area as necessary to form the desired spray edge exiting from the spray deflector 15 to provide the proper angular discharge. A narrow axial rib 38 is formed on wall 7 of housing 3A extending along the inner lower cylindrical surface 7B from the bottom thereof, to meet with the rib 13, both being of the same width, on diverging surface 7A. The inner surface of axial rib 38 has a slidable engagement with cylindrical member 24 such as axial rib 36 has with cylindrical surface 7B.

The cylindrical member 24 has a groove 40 in the top thereof for receiving the end of a screwdriver, for example, for turning it to move axial rib 36 with respect to axial rib 38. It can be seen that an adjustable arcuate discharge slot 50A is formed between the movable axial rib 36, axial rib 38, cylindrical surface 7B, and cylindrical member 24. With spiral surface 28A biased against the spiral surface 42A, such as by water pressure, it can be seen that as the arc set selection member 21 is rotated clockwise to increase the adjustable arcuate discharge slot 50A, the spiral surface 28A is cammed downwardly rotating the movable axial rib 36 away from the axial rib 38.

Arcuate discharge slot area 50A is supplied with flow through the opening created by the stepped spiral surfaces' interaction as defined in FIG. 4 by the opening with sides 42A, 38, 28A and 29. This supply area is desired to be two to three times the area of the discharge arcuate slot 50.

Figure 5:
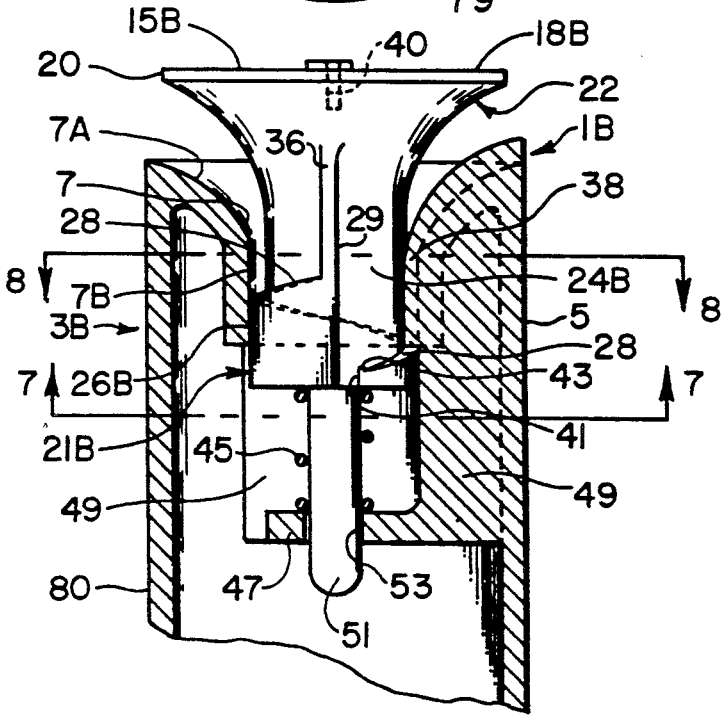
FIG. 5 is a cross-sectional side elevation view of a second modification of an adjustable arc of coverage spray nozzle with a combined arc set selection member and spray deflector member which is removable from the cylindrical top of a sprinkler riser.
Figure 7:
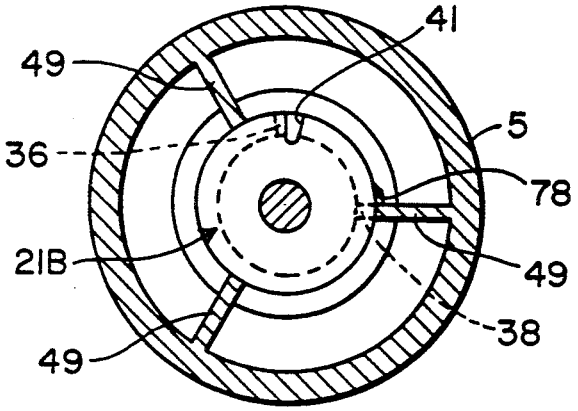
FIG. 7 is a sectional view taken along line 7—7 of FIG. 5 showing the position of the fixed and movable ribs of the arc selection with slot end flow enhancement notches shown.

A modified spray nozzle assembly 1B shown in FIG. 5 is integrally connected to the top of a riser 80. This nozzle assembly 1B comprises two parts:

(1) a cylindrical housing 3B formed at the top of a riser 80; and (2) a combined spray deflector member 15B and arc set selection member 21B.

The cylindrical housing 3B includes an outer circular wall 5 and an inner wall 7. Inner wall 7 has an upper upwardly diverging surface 7A and a lower cylindrical surface 7B. Riser 80 supplies pressurized water to the nozzle assembly 1B. A narrow axial rib 38 is formed on wall 7 of housing 3B extending along the inner lower cylindrical surface 7B from the bottom thereof to the top of diverging surface 7A.

The top of arc set selection member 21B is formed with an upwardly diverging deflecting surface 22. The diverging deflection surface 22 has a round top surface 18B with a small peripheral edge 20; a cylindrical member 24B extends downwardly from the bottom of the diverging surface 22. Cylindrical member 24B has an enlarged lower end 26B. Said enlarged lower end 26B appears as a sleeve-like member fixed to the cylindrical member 24B with a diameter larger than cylindrical member 24B, and being coaxial therewith. Said sleeve-like member has an upwardly facing spiral surface 28 extending substantially 360° around the cylindrical member 24B, and a downwardly facing lower surface at the bottom of cylindrical member 24B extending for a greater part of its circumference forming a radial extension thereof. Enlarged lower end 26B has a diameter sized to have a rotatable and slidable fit in the inner cylindrical surface 7B of housing 3B.

A narrow axial rib 36 is formed on the surface of cylindrical member 24B extending upwardly from the upper end of spiral surface 28 in line with the axial stepped surface 29 to permit axial movement of the arc set selection member 21 as it relates to the proper arc.

The round flat top surface 18B of arc set selection member 21B has a groove 40 for receiving the end of a screwdriver, for example, for turning it to move axial rib 36 with respect to axial rib 38. It can be seen that an adjustable arcuate discharge slot is formed between axial rib 36, axial rib 38, cylindrical surface 7B, and cylindrical member 24B. The operation is the same as in FIG. 1.

The smaller part of this circumference of the radial extension of cylindrical member 24B left open is an opening 41 axially throughthe low end of the spiral surface 28 adjacent stepped surface 29. A short projection 43 at the low end of the spiral surface 28 prevents the low end of the axial rib 38 from running into opening 41 and accidentally permitting the arc set selection member 21B to be disconnected. When it is desired to remove arc set selection member 21B, the arc set selection member 21B is moved downwardly and rotated to intentionally align the axial rib 38 with the opening 41.

To maintain the spray nozzle assembly 1B assembled with spiral surface 28 against the bottom axial rib 38, a spring 45 is placed between the bottom of the arc set selection member 21B and a small circular plate 47 supported by three equally spaced ribs 49 connected to the riser 80. A support and guide pin 51 is connected to the center of the bottom of the arc set selection member 21B and extends through the coil spring 45 and through a hole 53 in the middle of small circular plate 47. This arrangement provides for proper alignment and movement of the arc set selection member 21B.

The arc set relationship of the right and left sides of the spray pattern are shown by the arrowhead 79 and the rib 38 whose relationship can be seen from a view of the top of the spray nozzle.

Slot end flow enhancement notches can be formed as a radial cut-out into cylinder wall 7B adjacent the fixed axial rib 38 and radially inward cut 41 into cylindrical surface of enlarged end 26B and shaft 24B at the movable axial rib 36.

Figure 8:
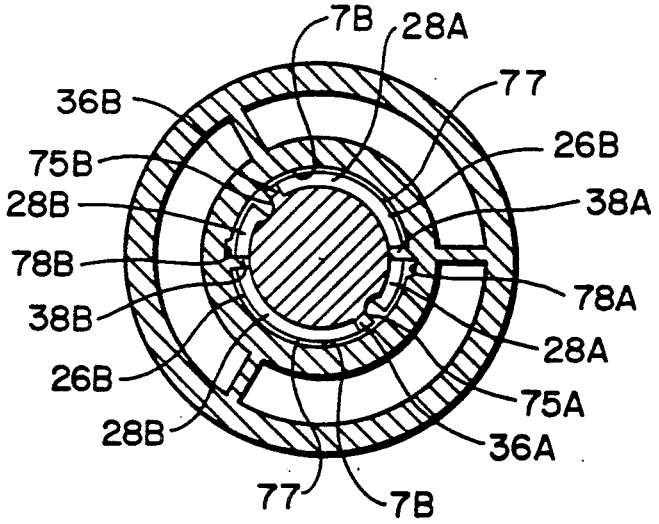
FIG. 8 is a sectional view taken along line 8—8 of FIG. 5 showing the adjustable arcuate flow control slot as modified to produce a generally rectangular pattern.

FIG. 8 shows a modified sectional view looking down along line 8—8 of FIG. 5 showing the adjustable arcuate discharge flow control slot of a modified arcuate valving means as modified to produce duplicate adjustable arcuate sprays 180° apart as is desired for strip spray sprinklers used to produce rectangular patterns.

The adjustable arcuate valving area has been configured to provide for two fixed axial ribs 38A and 38B with two movable axial ribs 36A and 36B and matching spiral surfaces 28A and 28B extending approximately 180° around the lower end of arc set member 21B but whose function is the same as that described for spiral surface 28 and fixed axial rib 38 in FIG. 5.

Flow enhancement radial cut-outs at 78A and 75A and 78B and 75B enhance the amount of water at each side of each of the 180° apart spray patterns, giving these edges enhanced range and better defined rectangular corners.

Also shown is the concept of reducing the diameter of enlarged lower end 26B of arc set selection member 21B to provide a circumferential gap 77 between it and the housing cylindrical surface 7B. If this is done, a short range spray is produced for this thin sheet of water which strikes the flow deflector surface 22 and is deflected outwardly from the nozzle for all areas around the circumference where this thin gap 77 exists. The full adjustable arc spray pattern is produced between ribs 38A and 36A, and 38B and 36B as previously described for the single adjustable arc spray of FIG. 5.

Figure 9:
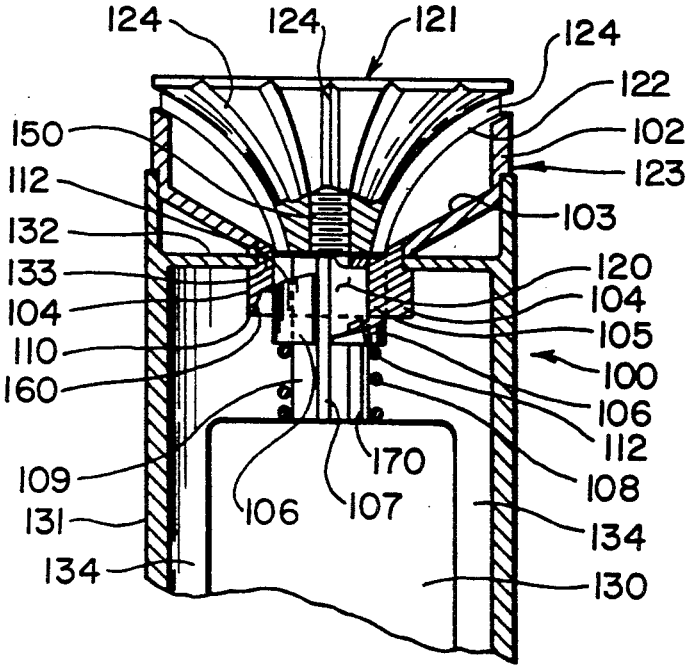
FIG. 9 is a cross-sectional side elevation view of an adjustable arc of coverage rotating distributing nozzle on a sprinkler riser.

An adjustable arc of coverage rotating distributing nozzle sprinkler 100 is shown in FIG. 9. This sprinkler consists of five (5) main parts as follows:

(1) a fixed cylindrical housing, or riser 131;

(2) arc set selection means 123;

(3) rotating distributing head 121;

(4) a fixed center bearing post 109; and (5) a center sleeve-like member 106.

The riser 131 has an annular cover flange 132 adjacent the top thereof having a center hole 133. Arc set selection means 123 includes an arcuate slot outer cylinder 104 mounted for rotation in center hole 133. An inverted truncated conical member 103 positioned above the cover flange 132 has its smaller end fixed to arcuate slot outer cylinder 104 and has its larger end mounted on the top of riser 131 for rotation. A cylindrical member 102 is connected to the larger end so that it can turn the arcuate slot outer cylinder 104 when desired for arc selection. The arcuate slot outer cylinder 104 has a movable arcuate slot closure rib 105.

The fixed center bearing post 109 extends upwardly from a rotary drive housing 130 in the riser 131, into the arcuate slot outer cylinder 104 to the top thereof. A fixed arcuate slot closure rib 107 extends axially along the fixed center bearing post 109. An adjustable arcuate slot opening 120 is formed between the arcuate slot closure ribs 105 and 107, the surface of bearing post 109, and the inner surface of outer cylinder 104. The adjustable arcuate slot opening 120 is adjustable from the outside by cylindrical member 102. A sleeve-like member 106 having an upper spiral surface 112 and a flat lower surface is slidably placed over fixed center bearing post 109 with a slot at the location of the axially displaced ends of the spiral surface 112. The fixed rib 107 is placed in said slot. A coil spring 108 is placed around said fixed center bearing post 109 with one end against the flat lower surface of sleeve-like member 106 and the other end against the top of housing 130. This spring action biases the spiral surface 112 against arcuate slot closure rib 105 for movement into or out of the space between center bearing post 109 and outer cylinder 104.

When the arcuate slot outer cylinder 104 is rotated in a counter-clockwise direction by cylindrical member 102, movable arcuate slot closure rib 105 cams the sleeve-like member 106 downward against spring 108 to provide a desired larger arcuate slot opening 120 to feed water pressure to the setable arcuate discharge orifice slot as previously described for the FIG. 1 spray nozzle. When the arcuate slot outer cylinder 104 is rotated in a clockwise direction, spring 108 biases sleeve-like member 106 upward to provide a desired smaller arcuate slot opening 120.

Rotating distributing head 121 is fixed to a rotary drive shaft 150 extending from the upper end of bearing post 109. A drive mechanism is located in housing 130. As flow is discharged axially upward through the arcuate discharge slot opening 120, it strikes the rotating distributing head 121 and curved, diverging, deflecting surface 122. There are stream forming notches, or channels, 124 on this curved inverted conical surface 122. The arcuate discharge orifice slot axial sheet of water strikes surface 122 and is turned radially outward. The stream channels 124 collect some of the axial discharge sheet into discrete streams of water that have more momentum and penetrate the air to a greater distance than the spray droplets exiting the sprinkler deflector off a smooth surface 122.

Riser 131 has a water source connected to its lower end to provide the driving fluid for the rotating drive contained in housing 130 and then is supplied up through annular area 134 to the open area above the housing 130. An additional axial flow passage 170 is cut inwardly into the center drive shaft housing 130 and as top surface 112 is moved down below the top of passage 170, additional flow is provided.

For special pattern effects such as localizing increased range of coverage, an additional flow opening 160 may be provided in the lower inner surface 110 of slot outer cylinder 104 that faces the side surface of sleeve-like member 106. When sleeve-like member 106 is moved downward, at one point the top surface of the opening 160 becomes open above the spiral surface 112, admitting additional flow between the fixed rib 107 and movabole rib 105.

In a modified form, the lower edge surface 110 of the slot outer cylinder 104 could have a matching spiral surface to that of the top surface 112 of the outer cylinder 104 to achieve the seal arrangement of FIG. 4.

Figure 10:
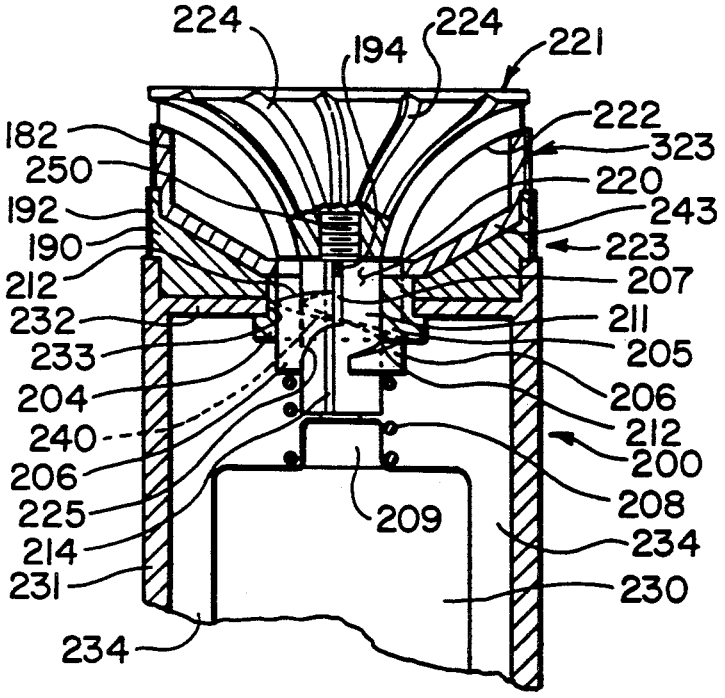
FIG. 10 is a sectional view of an adjustable arc of coverage rotating distributing nozzle sprinkler on a riser with a modified arc adjustment means which allows both of the arc extremes to be adjusted separately for proper alignment to the desired area of coverage on the ground.

An adjustable arc of coverage rotating distributing nozzle sprinkler 200 is shown in FIG. 10. This sprinkler consists of seven (7) main parts as follows:

(1) a fixed cylindrical housing, or riser 231;
(2) arc set selection means 223;
(3) arc set selection means 323;
(4) rotating distributing head 221;
(5) a fixed center bearing post 209;
(6) a bearing sleeve 211;
(7) a center sleeve-like member 206.

The riser 231 has an annular cover flange 232 adjacent the top thereof with a center hole 233. Arc set selection member 223 includes an arcuate slot outer cylinder 204 mounted for rotation in center hole 233. A flange extends from the bottom of cylinder 204 under the edge of flange 232 around the center hole 233. A flange-like member 190 is fixed adjacent to the top of the cylinder 204 and extends over the top of flange 232. Flange-like member 190 extends to the top of riser 231 and forms a rotatable upper cylindrical extension 192 of the riser 231. Cylindrical extension 192 is connected to flange-like member 190 so that it can turn the arcuate slot outer cylinder 204 when desired for arc selection. The arcuate slot outer cylinder 204 has an arcuate slot closure rib 205 thereon.

The fixed center bearing post 209 extends a short distance upwardly from a rotary drive housing 230 in the riser 231. Bearing sleeve 211 is positioned in line with fixed center bearing post 209 and extends through the arcuate slot outer cylinder 204 to extend a small distance above the top thereof. An arcuate slot closure rib 207 extends axially along the outer surface of the bearing sleeve 211 to the top thereof.

An inverted truncated conical member 243 positioned above the flange-like member 190 has its smaller end fixed to the top of bearing sleeve 211 by attachment to the top of rib 207 at 194 (other thin ribs can be used between the smaller end of inverted truncated conical member 243 and the top of bearing 211) and has its larger end mounted to a riser extension 182 of arc set selection means 323 on the top of cylindrical extension 192. An adjustable arcuate slot opening 220 is formed between the arcuate slot closure ribs 205 and 207, the surface of bearing sleeve 211 and the inner surface of outer cylinder 204. The adjustable arcuate slot opening 220 is adjustable from the outside by cylindrical extension 192 and cylindrical extension 182.

A sleeve-like member 206 has an upper spiral surface 212 and a flat lower surface and is slidably located over bearing sleeve 211 with a slot at the location of the axially displaced ends of the spiral surface 212. The fixed rib 207 is placed above said slot. An axial groove 214 is located in the outer surface of bearing sleeve 211 adjacent the arcuate slot closure rib 207, and an axial projecting rib 240 extends inwardly on the inner surface of sleeve-like member 206 to slidably engage the axial groove 214. This permits relative axial movement between sleeve-like member 206 and bearing sleeve 211 and maintains fixed rotational movement therebetween.

A coil spring 208 is placed around said fixed center bearing post 209 and bearing sleeve 211 with one end against the flat lower surface of sleeve-like member 206 and the other end against the top of housing 230. This spring action biases the spiral surface 212 against arcuate slot closure rib 205 for movement into or out of the space between bearing sleeve 211 and outer cylinder 204.

When the arcuate slot outer cylinder 204 is rotated in a counter-clockwise direction by cylindrical extension 192, arcuate slot closure rib 205 moves away from arcuate slot closure rib 207 to provide a desired larger arcuate slot opening 120 to feed water pressure to the setable arcuate discharge orifice slot. When the arcuate slot outer cylinder 204 is rotated in a clockwise direction, arcuate slot closure rib 205 moves toward arcuate slot closure rib 207 to provide a desired smaller arcuate slot opening 220.

When the bearing sleeve 211 is rotated in a counter-clockwise direction by cylindrical extension 182, arcuate slot closure rib 207 moves toward arcuate slot closure rib 205 to provide a desired smaller arcuate slot opening 220 to feed water pressure to the setable arcuate discharge orifice slot. When the bearing sleeve 211 is rotated in a clockwise direction, arcuate slot closure rib 207 moves away from arcuate slot closure rib 205 to provide a desired larger arcuate slot opening 220.

Rotating distributing head 221 is fixed to a rotary drive shaft 250 extending from the upper end of bearing sleeve 211. A drive mechanism is located in housing 230. As flow is discharged axially upward through the arcuate discharge slot opening 220, it strikes the rotating distributing head 221 and curved, diverging, deflecting surface 222. There are stream forming notches, or channels, 224 on this curved inverted conical surface 222. The arcuate discharge orifice slot axial sheet of water strikes surface 222 and is turned radially outward. The stream channels 224 collect some of the axial discharge sheet into discrete streams of water that have more momentum and penetrate the air to a greater distance than the spray droplets exiting the sprinkler deflector off a smooth surface 222.

Riser 231 has a water source connected to its lower end to provide the driving fluid for the rotating drive contained in housing 230 and then is supplied up through annular area 234 to the open area above the housing 230. An additional inlet flow passage 225 is cut inwardly into the underside of sleeve-like member 206 (see FIG. 1).

While the principles of the invention have now been made clear in an illustrative embodiment, it will become obvious to those skilled in the art that many modifications in arrangement are possible without departing from those principles. The appended claims are, therefore, intended to cover and embrace any such modifications, within the limits of the true spirit and scope of the invention.

I claim:

1. A sprinkler having a nozzle with an adjustable arc of coverage, said nozzle having a tubular body means with a center opening therethrough, said tubular body means having two ends with an inlet means at one end for receiving pressurized water, a spray deflector member fixed to and spaced from the other end of said tubular body means, said center opening having a cylindrical section at said one end, said spray deflector member having a center cylindrical opening coaxial with said cylindrical section, an arc set member having two ends, one end of said arc set member comprising a first cylindrical portion positioned in said center cylindrical opening for axial movement and rotation, the other end of said arc set member having a second cylindrical portion having a larger diameter positioned in said cylindrical section for axial movement and rotation, said second cylindrical portion forming a stepped peripheral surface with said first cylindrical portion, said stepped peripheral surface being formed as a spiral surface ending in two axially spaced ends, a first axially extending rib extends on said arc set member towards said spray deflector member from one end of the spiral surface, said first rib being movable with said arc set member, said first rib defining one side of an adjustable arcuate discharge orifice, a second axially extending rib fixed to the cylindrical section of said center opening of said tubular body means, said second axially extending rib having two ends, an outer end extending to define a second side of the adjustable arcuate discharge orifice, the other end engaging said stepped peripheral surface to guide axial movement of said arc set member.

2. The sprinkler nozzle as set forth in claim 1 wherein the top of said first rib has a top end curved inwardly to maintain a selected arcuate discharge flow.

3. A sprinkler having a nozzle with an adjustable arc of coverage, said nozzle having a tubular body means with a center opening therethrough, said tubular body means having an inlet end and outlet end with an inlet means at said inlet end for receiving pressurized water, a spray deflector member positioned at the other outlet end of said tubular body means, said center opening having a cylindrical section with an inner cylindrical surface, an arc set member having an adjustable arcuate inlet valving means located at the inlet end of said tubular body means, a cylindrical member positioned in the center of said cylindrical section of said center opening with an outer cylindrical surface, said inner and outer cylindrical surfaces forming an arcuate circumferential discharge slot for directing pressurized water onto said spray deflector.

4. The sprinkler nozzle of claim 3 including a first axially extending rib defining an end surface between the inner and outer cylindrical surfaces of the arcuate circumferential discharge slot and a second axially extending rib forming the other end surface between the inner and outer cylindrical surfaces of the arcuate circumferential discharge slot, said axially extending ribs being relatively movable and aligned with the adjustable arcuate inlet valving means.

5. The sprinkler nozzle as set forth in claim 3 wherein an annular member extends downwardly from the tubular body means around the center opening, said annular member has axial cut-out sections for providing a water inlet to said nozzle, a disc mounted for axial movement in said annular member, said disc being mounted on a shaft threaded into said arc set member, axial movement of said disc controls water through said axial cut-out sections.

6. A sprinkler having a nozzle with an adjustable arc of coverage, said nozzle having a tubular body means with a center opening therethrough, said tubular body means having two ends, an inlet end for receiving pressurized water, a spray deflector means at the other end of said tubular body means for deflecting water therefrom, said center opening having a cylindrical section extending to the inlet end, an arc set means being positioned in said cylindrical section for axial and rotational movement, said arc set means having a portion forming a valving means with the inlet end of said cylindrical section, said arc set means having a cylindrical portion positioned in the center of said cylindrical section of said center opening for forming an arcuate circumferential discharge slot for directing water flow onto said spray deflector means.

7. The sprinkler nozzle as set forth in claim 6 including a first axially extending rib on said cylindrical section defining an end surface of said arcuate circumferential discharge slot between said cylindrical section and said cylindrical portion, a second axially extending rib on said cylindrical portion defining the other end surface of said arcuate circumferential discharge slot between said cylindrical portion and said cylindrical section, said axially extending ribs being relatively movable and positioned to receive flow therebetween from the valving means.

8. The sprinkler nozzle as set forth in claim 7 including inlet means for providing additional flow between said arc set means and said cylindrical section to said arcuate circumferential discharge slot.

9. The sprinkler nozzle as set forth in claim 7 wherein said spray deflector means is fixed to said tubular body means.

10. The sprinkler nozzle as set forth in claim 9 wherein said spray deflector means has an opening therethrough, said arc set member having said cylindrical portion extend into said opening.

11. The sprinkler nozzle as set forth in claim 7 wherein said spray deflector means is fixed to said arc set means.

12. The sprinkler nozzle as set forth in claim 11 having biasing means biasing said arc set means upwardly.

13. The sprinkler nozzle as set forth in claim 11 having slot means for disconnecting said arc set means from said tubular body means.

14. A sprinkler having a nozzle with an adjustable arc of coverage, said nozzle having a tubular body means with a center opening therethrough, said tubular body means having two ends with an inlet means at one end for receiving pressurized water, a spray deflector means spaced from the other end of said tubular body means, said center opening having a cylindrical section at said one end, an arc set means having two ends, one end of said arc set means comprising a first cylindrical portion having a diameter smaller than said cylindrical section of said center opening and being positioned in the center thereof, the other end of said arc set means having a second cylindrical portion having a larger diameter positioned with respect to said cylindrical section for axial movement and rotation, said second cylindrical portion forming a stepped peripheral surface with said first cylindrical portion, said stepped peripheral surface being formed as a spiral surface ending in two axially spaced ends, a first axially extending rib extends on the first cylindrical portion of said arc set means towards said spray deflector means from the end of the spiral surface defining one side of an adjustable arcuate discharge orifice, said first rib being movable with said arc set means, a second axially extending rib is fixed to the cylindrical section of said center opening of said tubular body means, said second axially extending rib having two ends, an outer end extending to define a second side of the adjustable arcuate discharge orifice, the other end engaging said stepped peripheral spiral surface to guide axial movement of said arc set means.

15. The sprinkler nozzle as set forth in claim 14 having a plurality of ribs extending downwardly from the one end of said tubular body means for guiding the arc set means, said ribs having projections for preventing said arc set means from becoming separated from the tubular body means.

16. A sprinkler having a nozzle with an adjustable arc of coverage, said nozzle having a tubular body means with a center opening therethrough, said tubular body means having two ends with an inlet means at one end for receiving pressurized water, a spray deflector means fixed to and spaced from the other end of said tubular body means, said center opening having a cylindrical section, an arc set selection means, said arc set selection means having a cylindrical member of smaller diameter positioned in said center opening cylindrical section, said arc set selection means having a lower cylindrical portion having a larger diameter positioned in said cylindrical section for rotational and axial movement, said larger cylindrical portion forming a stepped peripheral surface with said cylindrical member, said stepped peripheral surface being formed as a spiral surface ending in two axially spaced ends, means providing an arcuate adjustable opening for flow to enter an arcuate axial discharge slot created between said center opening cylindrical section and the outside surface of said cylindrical member and be discharged against said spray deflector means.

17. The sprinkler nozzle as set forth in claim 16 including a first axially extending rib on said cylindrical section defining an end surface of said arcuate axial discharge slot between said cylindrical section and said cylindrical member, a second axially extending rib on said cylindrical member defining the other end surface of said arcuate axial discharge slot between said cylindrical member and said cylindrical section, said axially extending ribs being relatively movable and positioned to receive flow therebetween from the arcuate adjustable opening to provide an adjustable arcuate axial discharge slot.

18. A sprinkler having a nozzle for distribution of water precipitation with an adjustable arc of coverage, said nozzle having an arcuate axial discharge slot for directing water axially therefrom, means for adjusting the arcuate length of said arcuate axial discharge slot with movable slot enclosures for adjusting the precipitation coverage to a selected ground coverage, indicating means readable from on top of the nozzle for presetting of the adjustable arcuate length, said indicating means pointing directly to each limit of arcuate coverage.

19. A sprinkler with an adjustable arc of coverage nozzle, said nozzle having an arcuate discharge orifice with an adjustable arcuate length for supplying water to a rotating stream distributor to discharge the water as rotating multiple streams over an adjustable arc of coverage, said arcuate discharge orifice having an axially movable inlet valving means for controlling flow to said discharge orifice, means for adjusting said arcuate length to change the arc of coverage without disassembling said nozzle.

20. An adjustable arc of coverage sprinkler comprising a fixed housing means defining a passage having an inlet for attachment to a source of pressurized water and an outlet defined by an arcuate axial orifice of adjustable arcuate length discharging axially onto a deflector for distributing the water precipitation over a selectable arc of coverage, means for adjusting the arcuate length of said arcuate axial orifice from approximately zero degrees to approximately three hundred sixty degrees with relatively movable orifice end closures for adjusting the precipitation coverage to a selected ground coverage.

21. An adjustable arc of coverage sprinkler comprising a fixed housing means defining a passage having an inlet for attachment to a source of pressurized water and an outlet defined by an arcuate axial orifice of adjustable arcuate length discharging axially onto a deflector for distributing the water precipitation over a selectable arc of coverage, said adjustable arcuate length axial orifice being created between two closure ribs, the outside surface of a center cylindrical shaft, and the inside surface of a larger diameter cylindrical outlet tube at the discharge end of said housing with at least one of the two closure ribs being movable; flow to said adjustable arcuate length axial orifice being supplied by an arcuate adjustable valving means at the inlet end of said cylindrical outlet tube.

22. The adjustable arc of coverage sprinkler as set forth in claim 21 wherein at least one of the two closure ribs is attached to said center cylindrical shaft which is rotatably adjustable from the top surface of the sprinkler to adjust the annular position of this closure rib.

23. The adjustable arc of coverage sprinkler as set forth in claim 22 wherein said center cylindrical shaft with said movable closure rib has said deflector attached to said center cylindrical shaft at said discharge end and is removable from the top of said sprinkler housing.

24. The adjustable arc of coverage sprinkler as set forth in claim 23 wherein said arcuate adjustable valving means is attached to said center cylindrical shaft at the inlet end of said larger diameter cylindrical outlet tube and is removable from the discharge end through said cylindrical outlet tube.

25. A sprinkler having a nozzle with an adjustable arc of coverage, said nozzle having a tubular body means with a center opening therethrough, said tubular body means having two ends, an inlet end for receiving pressurized water and an exit end, a spray deflector means fixed to and spaced from the exit end of said tubular body means, said center opening having a cylindrical section at said inlet end, said inlet end of said tubular body means having a downwardly facing first spiral surface around said cylindrical section, said spray deflector means having a center cylindrical opening coaxial with said cylindrical section, an arc set means having two ends, one end of said arc set means comprising a first cylindrical portion positioned in said center cylindrical opening for axial movement and rotation, the other end of said arc set means having a second cylindrical portion having a larger diameter than said cylindrical section, said second cylindrical portion forming a stepped peripheral surface with said first cylindrical section, said stepped peripheral surface being formed having an upwardly facing second spiral surface ending in two axially spaced ends, said first and second spiral surfaces engaging each other providing axial movement; a first axially extending rib extends on said arc set means towards said spray deflector means from one end of the second spiral surface, said first rib being movable with said arc set means, a second axially extending rib is fixed to the cylindrical section of said center opening of said tubular body means, said second axially extending rib having two ends, an outer end extending to define one side of an adjustable arcuate discharge orifice, the other end engaging said second spiral surface.

26. The sprinkler nozzle as set forth in claim 25 wherein an annular member extends downwardly from around said first spiral surface, said annular member has axial cut-out sections for providing a water inlet to said nozzle, a disc mounted for axial movement in said annular member, said disc being mounted on a shaft threaded into said arc set means, axial movement of said disc controls water through said axial cut-out sections.

27. A sprinkler with an adjustable arc of coverage nozzle, said nozzle having an adjustable arcuate discharge orifice for supplying water to a rotating stream distributor to discharge the water as rotating multiple streams over an adjustable arc of coverage, a cylindrical housing having an annular partition adjacent the top thereof, a first cylindrical member mounted for rotation in said annular partition, a second cylindrical member mounted for rotation on the top of said cylindrical housing and fixed to said first cylindrical member for rotating it, the inner surface of the first cylindrical member having a first axial rib, a fixed center bearing post extending into said first cylindrical member, a second axial rib fixed to said center bearing post, a sleeve-like member having an upper spiral surface and a lower surface slidably positioned around said center bearing post and extending into said first cylindrical member, a slot located axially through said sleeve-like member at the location of the displaced ends of the spiral surface, said slot being placed over said second axial rib, biasing means for pressing the spiral surface against the first axial rib, whereby rotation of said second cylindrical member controls the adjustable arcuate discharge orifice, a rotatable distributing head being fixed to a shaft extending from said center bearing post, said distributing head has stream forming slots to provide a desired distance and spray precipitation, the adjustable arcuate discharge orifice formed between the first and second axial ribs, the inner surface of the first cylindrical member and the outer surface of said center bearing post.

28. The sprinkler with an adjustable arc of coverage nozzle as set forth in claim 27 wherein said center bearing post has an axial groove in the surface thereof, said groove extending from just below said first cylindrical member to below the lower surface of said sleeve-like member.

29. A sprinkler with an adjustable arc of coverage nozzle, said nozzle having an adjustable arcuate discharge orifice for supplying water to a rotating stream distributor to discharge the water as rotating multiple streams over an adjustable arc of coverage, a cylindrical housing having an annular partition adjacent the top thereof, a first cylindrical member is mounted for rotation in said annular partition, a second cylindrical member is mounted for rotation on the top of said cylindrical housing and fixed to said first cylindrical member for rotating it, the inner surface of the first cylindrical member having a first axial rib, a rotatable bearing sleeve extending into said first cylindrical member, a second axial rib fixed to said bearing sleeve, a third cylindrical member is mounted for rotation on said second cylindrical member and fixed to said bearing sleeve for rotating it, a sleeve-like member having an upper spiral surface and a flat lower surface being slidably positioned around said bearing sleeve and extending into said first cylindrical member, a slot being located axially through said sleeve-like member at the location of the displaced ends of the spiral surface, an axial groove extending the length of the outer surface of said bearing sleeve, said sleeve-like member having a third axial rib extending along its inner surface, said third axial rib on said sleeve-like member engaging said axial groove on said bearing sleeve, biasing means pressing the spiral surface against the first axial rib, whereby rotation of said second cylindrical member controls the adjustable arcuate discharge orifice, whereby rotation of said third cylindrical member controls the adjustable arcuate discharge orifice, a rotatable distributing head being fixed to a shaft extending from said bearing sleeve, said distributing head has stream forming slots to provide a desired distance and spray precipitation, the adjustable arcuate discharge orifice is formed between the first and second axial ribs, inner surface of the first cylindrical member, and outer surface of said bearing sleeve.

30. A strip spray sprinkler comprising a fixed housing means defining a passage having an inlet for attachment to a source of pressurized water and two outlets defined by two adjustable length arcuate axial slots discharging onto a deflector at two different locations for distributing the water precipitation over two selectable arcs of coverage.

31. A strip spray sprinkler comprising a fixed housing means defining a passage having an inlet for attachment to a source of pressurized water and two outlets defined by two adjustable length arcuate axial slots discharging onto a deflector at two different locations for distributing the water precipitation over two selectable arcs of coverage, each adjustable length arcuate axial slot is created between the outside surface of a center cylindrical shaft and the inside surface of a larger diameter cylindrical outlet tube at the discharge end of said housing between two end closure ribs with at least one of the two arcuate slot end closure ribs being movable, flow to said adjustable length arcuate axial slots being supplied by an arcuate adjustable valving means at the inlet end of said cylindrical outlet tube.

32. A sprinkler having a nozzle with an adjustable arc of coverage, said nozzle having a tubular body means with a center opening therethrough, said tubular body means having two ends with an inlet means at one end for receiving pressurized water, a spray deflector member fixed to and spaced from the other end of said tubular body means, said center opening having a cylindrical section at said one end, said spray deflector member having a center cylindrical opening coaxial with said cylindrical section, an arc set member having two ends, one end of said arc set member comprising a first cylindrical portion positioned in said center cylindrical opening for axial movement and rotation, the other end of said arc set member having a second cylindrical portion having a larger diameter positioned in said cylindrical section for axial movement and rotation, said second cylindrical portion forming a stepped peripheral surface with said first cylindrical portion, said stepped peripheral surface being formed as a spiral surface ending in two axially spaced ends, a first axially extending rib extends on said arc set member towards said spray deflector member from one end of the spiral surface, said first rib being movable with said arc set member, said first rib contacting said cylindrical section of said center opening of said tubular body means defining one end of an adjustable arcuate discharge orifice, a second axially extending rib fixed to the cylindrical section of said center opening of said tubular body means contacting said first cylindrical portion of said arc set member, said second axially extending rib having two ends, an outer end extending to define a second end of the adjustable arcuate discharge orifice, the other end engaging said stepped peripheral surface to guide axial movement of said arc set member.

33. A sprinkler nozzle having a tubular body means with a center opening therethrough, said tubular body means having two ends with an inlet means at one end for receiving pressurized water, a spray deflector means at the other end of said tubular body means, said center opening having a cylindrical section, a cylindrical member positioned axially in said cylindrical section and having a diameter smaller than said cylindrical section forming an arcuate axial discharge slot for directing water flow onto said spray deflector means, the arcuate length of said arcuate axial discharge slot being defined by a larger cylindrical portion on said cylindrical member and sized to have a movable tight fit with said cylindrical section of said tubular body.

34. The sprinkler nozzle as set forth in claim 33 wherein said spray deflector means and said cylindrical member are formed as a single piece and removable from the other end of the tubular body means.

35. The sprinkler nozzle as set forth in claim 33 wherein an annular member extends downwardly from the tubular body means around the center opening, said annular member has axial cut-out sections for providing a water inlet to said nozzle, a disc mounted for axial movement in said annular member, said disc being mounted on a shaft threaded into said cylindrical member, axial movement of said disc controls water through said axial cut-out sections.

36. A sprinkler having a nozzle with a changeable arc of coverage, said nozzle having a tubular body means with a center opening therethrough, said tubular body means having two ends, an inlet end for receiving pressurized water, a spray deflector means at the other end of said tubular body means for deflecting water, said spray deflector means having a spray deflector and a cylindrical portion, said center opening having a cylindrical section, said cylindrical portion of said spray deflector means positioned in the center of said cylindrical section of said center opening for forming an arcuate circumferential axial discharge slot therewith for directing water flow onto said spray deflector, said cylindrical portion having a larger diameter portion forming an axial flow shut off with said cylindrical section.

37. The sprinkler nozzle as set forth in claim 36 wherein the spray deflector and cylindrical portion are formed as a single piece and removable from the other end of the tubular body means.

38. A sprinkler having a nozzle with a changeable arc of coverage, said nozzle having a tubular body means with a center opening therethrough, said tubular body means having two ends, an inlet end for receiving pressurized water, a spray deflector means at the other end of said tubular body means for deflecting water, said spray deflector means having a spray deflector with a cylindrical portion, said center opening having a cylindrical section, said cylindrical portion of said spray deflector means positioned in the center of said cylindrical section of said center opening for forming an arcuate circumferential axial discharge slot therewith for directing water flow onto said spray deflector, said cylindrical portion having a larger diameter portion forming circumferential gap means with said cylindrical section for achieving different patterns, said circumferential gap means being sized to provide a desired flow pattern therearound.

39. The sprinkler nozzle as set forth in claim 38 wherein the spray deflector and cylindrical portion are formed as a single piece and removable from the other end of the tubular body means.

40. A sprinkler having a nozzle with an adjustable arc of coverage, said nozzle having a tubular body means with a center opening therethrough, said tubular body means having two ends, an inlet end for receiving pressurized water and an exit end, a spray deflector means spaced from the exit end of said tubular body means, said center opening having a cylindrical section at said inlet end, said inlet end of said tubular body means having a downwardly facing first spiral surface around said cylindrical section, an art set means having two ends, one end of said arc set means comprising a first cylindrical portion positioned in said center cylindrical opening for axial movement and rotation, the other end of said arc set means having a second cylindrical portion having a larger diameter than said first cylindrical portion, said second cylindrical portion forming a stepped peripheral surface with said first cylindrical portion, said stepped peripheral surface being formed having an upwardly facing second spiral surface ending in two axially spaced ends, said first and second spiral surfaces overlapping each other providing a seal over the overlapping area, a first axially extending rib extends on said arc set means towards said spray deflector means from one end of the second spiral surface, said first rib being movable with said arc set means, a second axially extending rib is fixed to the cylindrical section of said center opening of said tubular body means, said second axially extending rib having two ends, an outer end extending to define one side of an adjustable arcuate discharge orifice, the other end engaging said second spiral surface to provide a seal.

41. A sprinkler having a nozzle with an adjustable arc of coverage, said nozzle having a tubular body means with a center opening therethrough, said tubular body means having two ends, an inlet end for receiving pressurized water and an exit end, a spray deflector means spaced from the exit end of said tubular body means, said center opening having a cylindrical section at said inlet end, said inlet end of said tubular body means having a downwardly facing first spiral surface around said cylindrical section, an arc set means having two ends, one end of said arc set means comprising a first cylindrical portion positioned in said center cylindrical opening for axial movement and rotation, the other end of said arc set means having a second cylindrical portion having a larger diameter than said first cylindrical portion, said second cylindrical portion forming a stepped peripheral surface with said first cylindrical portion, said stepped peripheral surface being formed having an upwardly facing second spiral surface ending in two axially spaced ends, said first and second spiral surfaces overlapping each other providing a seal over the overlapping area to provide an adjustable arcuate inlet valving means located at the inlet end of said cylindrical section of said center opening with the cylindrical portion forming an arcuate circumferential discharge slot directing pressurized water onto said spray deflector.

* * * * *